US006361352B2

(12) United States Patent
Barrat et al.

(10) Patent No.: US 6,361,352 B2
(45) **Date of Patent: *Mar. 26, 2002**

(54) INSULATION-DISPLACEMENT CONNECTOR

(75) Inventors: Sylvain Barrat, Belleville sur Saône; Bernard Bechaz, Caluire; Philippe France, Chazelles sur Lyon, all of (FR)

(73) Assignee: Entrelec S.A., Villeurbanne (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/370,391

(22) Filed: Aug. 6, 1999

(30) Foreign Application Priority Data

Aug. 7, 1998 (FR) ..... 98 10311

(51) Int. Cl.[7] ..... H01R 11/20
(52) U.S. Cl. ..... 439/395; 439/406; 439/417
(58) Field of Search ..... 439/395–418, 439/839

(56) References Cited

U.S. PATENT DOCUMENTS 3,027,536 A * 3/1962 Pasternak ..... 174/84 S
4,806,120 A * 2/1989 Baker ..... 439/399
5,810,616 A * 9/1998 Ivey ..... 439/395
6,027,361 A * 2/2000 Burmeister et al. ..... 439/395

FOREIGN PATENT DOCUMENTS

| | | |
|---|---|---|
| DE | 19541137 | 5/1997 |
| EP | 0247360 | 4/1987 |
| EP | 0643440 | 3/1998 |
| FR | 2490029 | 9/1981 |
| FR | 2611406 | 2/1987 |
| FR | 0663105 | 7/1996 |

* cited by examiner

*Primary Examiner*—Neil Abrams
*Assistant Examiner*—Son V. Nguyen
(74) *Attorney, Agent, or Firm*—Ware, Fressola, Van Der Sluys & Adolphson LLP

(57) ABSTRACT

This slit-type insulation-displacement connector for electrical wire comprises a conducting connection piece (2) with a straight stripping and retaining slit (8) for the core of a wire. The slit is made longitudinally along a profiled part of the conducting piece. This connector furthermore comprises a metal reinforcement (4) made in a resilient material, which follows the shape of conducting piece (2) by surrounding it.

21 Claims, 4 Drawing Sheets

FIG 1
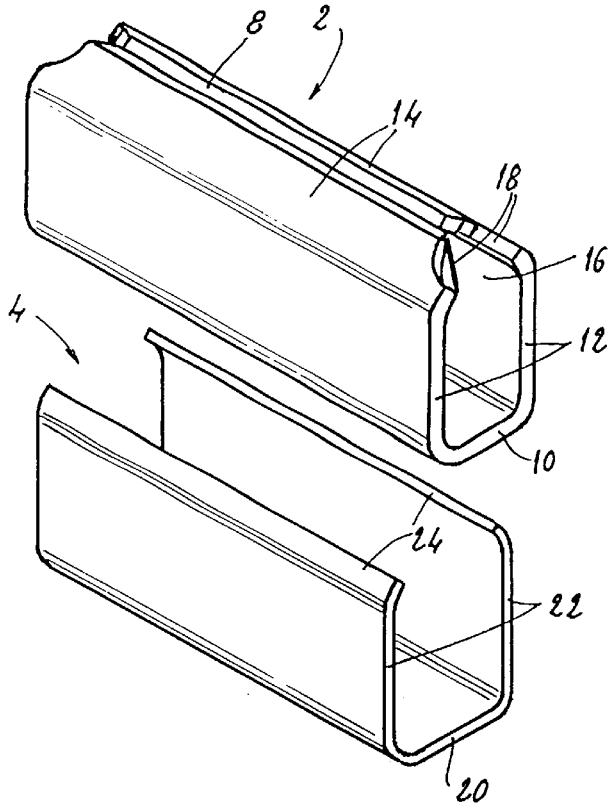
FIG 2
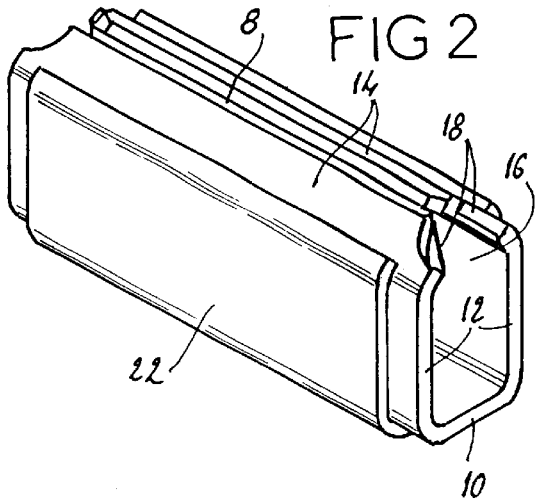
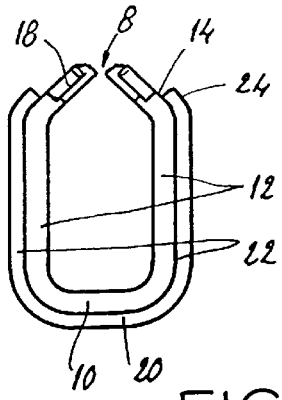
FIG 3
FIG 4
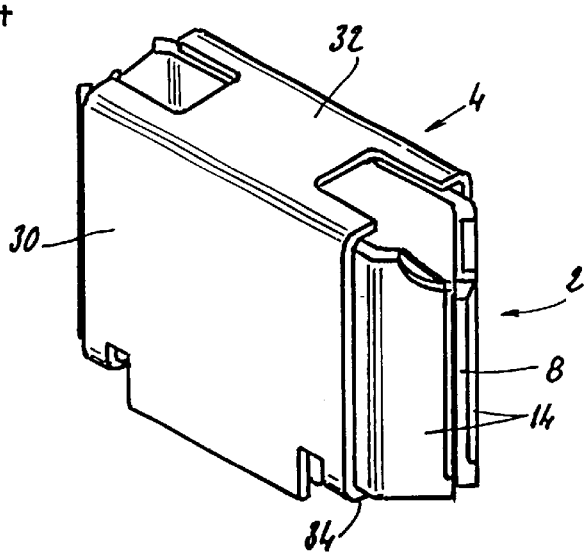

50
52
54
66
68
70
72
76

INSULATION-DISPLACEMENT CONNECTOR

BACKGROUND OF THE INVENTION

Technical Field

The present invention relates to an insulation-displacement connector.

Background of the Invention

It is known to make an electrical connection without having to prestrip the end of a cable to be connected. Several documents, such as Patent EP-0,247,360 for example, thus disclose an insulation-displacement connection arrangement with a slit for electrical wire, comprising a conducting connection piece with a straight stripping and retaining slit for the core of a wire. The slit is made longitudinally along a profiled part of the conducting piece.

There are several ways of introducing the end of a wire between the stripping and retaining slits of the conducting connection piece. In the aforementiond Patent EP-0,247,360, an external tool having an end-piece of suitable shape allows this wire to be introduced. As regards Patent FR-2,611,406, this provides a maneuvering piece molded with the casing and intended to serve as a pusher for making the end of the wire slip between the edges of the stripping slit. Other documents describe other examples of ways allowing the end of the wire to be introduced in order to make the insulation-displacement connection.

In known connectors, the conducting connection piece must firstly strip the wire and then make good electrical contact with it. It therefore must have good electrical conductivity properties, but also mechanical properties so as to guarantee that the sheath of the wire is cut and that there is sufficient contact force to make reliable contact. The materials known to be good conductors do not have the desired mechanical properties, especially from the elasticity standpoint, for allowing good stripping and satisfactory contact force.

When the conducting piece is not designed to take ends of wires which all have the same diameter, it is possible to adapt the shape of the connection piece in such a way that, by choosing a material having good or even excellent electrical properties, good stripping and an optimized contact force are achieved.

However, when the connection piece is intended to take ends of wires of different diameters, lying within a given range, it becomes difficult and even impossible to have both excellent results from an electrical standpoint and from a mechanical standpoint. The solution adopted therefore consists in making a compromise and in manufacturing the conducting connection piece from a material which has mechanical and electrical properties that are satisfactory without, however, being optimal. This requires the use of copper- and steel-based alloys which are relatively costly.

SUMMARY OF THE INVENTION

The object of the present invention is to provide a connector that does not require the use of an expensive material, while allowing satisfactory, or even very satisfactory, electrical and mechanical properties to be obtained.

For this purpose, the connector proposed by the invention is a slit-type insulation-displacement connector for electrical wire, comprising a conducting connection piece, with a stripping and retaining slit for the core of a wire, the slit being made longitudinally along a profiled part of the conducting piece.

According to the invention, this connector furthermore comprises a metal reinforcement made from a resilient material which follows the shape of the conducting piece by surrounding it.

Thus, the two functions—electrical conductivity and elasticity—are decoupled. The connection piece provides the electrical conductivity while the reinforcement provides the elasticity necessary for effective stripping and good electrical connection.

In a first embodiment, the connection piece of the connector according to the invention has a hollow polygonal cross section in the region of the stripping and retaining slit.

In another embodiment, the connection piece of the connector according to the invention has an approximately V-shaped section in the region of the stripping and retaining slit, the slit being located at the tip of the V.

In order to provide good electrical conductivity, the conducting connection piece is preferably made of copper or of a copper-based alloy.

In order to guarantee good elasticity, the metal reinforcement is made of steel, for example.

In a first arrangement of the connector according to the invention, the metal reinforcement is fitted tightly over the conducting connection piece.

In this case, the reinforcement is, for example, a profiled piece having the same axis as the conducting connection piece and having approximately the same cross section but with slightly larger dimensions.

It is also possible to have, in the case of an arrangement in which the reinforcement fits tightly over the conducting piece, a conducting connection piece having two opposed stripping and retaining slits as well as a linking element placed on one side, adjacent to the slits in order to maintain the profile, and a reinforcement in the form of a profiled piece having an axis perpendicular to the stripping and retaining slits.

In another arrangement of the connector according to the invention, the metal reinforcement is fitted so as to slide with respect to the conducting connection piece, longitudinally with respect to the latter.

In this case, the reinforcement is advantageously acted upon by a spring, the latter being at rest in a covering position in which the reinforcement surrounds the connection piece over approximately the entire length of the reinforcement and a preloaded position in which only one end of the reinforcement surrounds part of the connection piece. The spring and the reinforcement can form only a single piece. The spring can therefore be deformed and the energy stored in the preloaded spring can then be used for introducing a wire to be connected into the stripping and retaining slit.

In the case of a connection piece having a V-shaped section and of a sliding reinforcement forming with the spring only a single piece, the reinforcement has, for example, a profiled part of triangular cross section, where the side of the triangular part which is opposite the stripping and retaining slit is extended so as to form a bent resilient blade; the bent part advantageously comes to bear against a stop which is fixed with respect to the connection piece; a recess is advantageously provided in the reinforcement at the profiled part in order to allow the end of a wire intended to be stripped to pass through the stripping and retaining slit and an opening is preferably provided in the resilient blade allowing a rod, such as the end of a screwdriver for example, to pass through it.

BRIEF DESCRIPTION OF THE DRAWINGS

In any case, the invention will be clearly understood with the aid of the description which follows, with reference to the appended diagrammatic drawing, illustrating by way of nonlimiting examples a few embodiments of an insulation-displacement connector according to the invention:

FIGS. 12A to 15A show, in perspective, the connector of FIG. 11 in various positions during the connection of one end of an electrical wire; and FIGS. 12B to 15B each correspond to a side view of FIGS. 12A to 15A.

DESCRIPTION OF THE PREFERRED EMBODIMENTS

Figure 1:
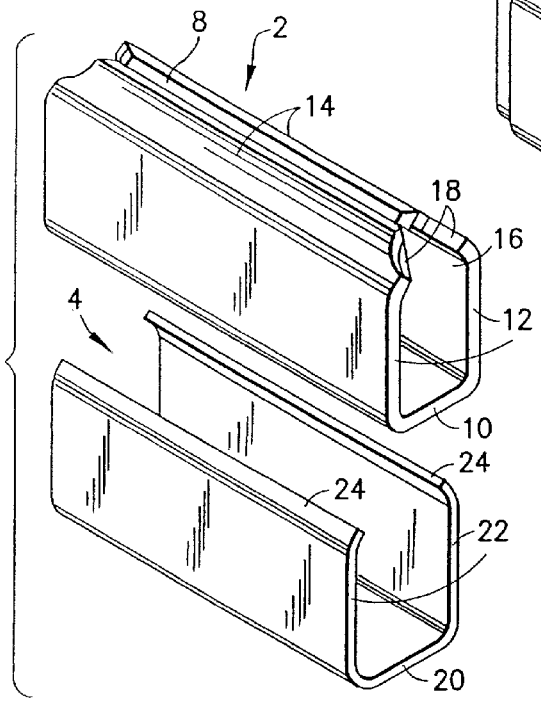
FIG. 1 is an exploded perspective view of a first embodiment of a connector according to the invention.
Figure 2:
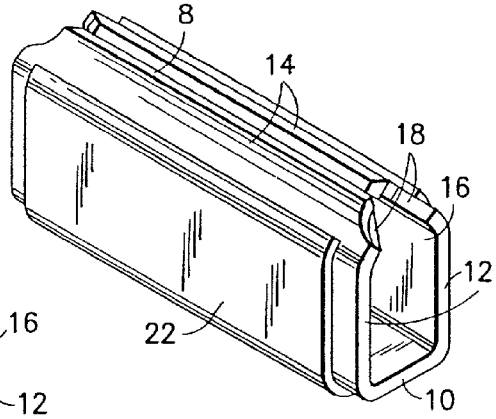
FIG. 2 shows the connector of FIG. 1 in perspective in the fitted position.
Figure 3:
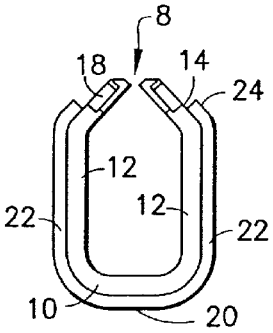
FIG. 3 is a front view of the connector of the previous figures.
Figure 4:
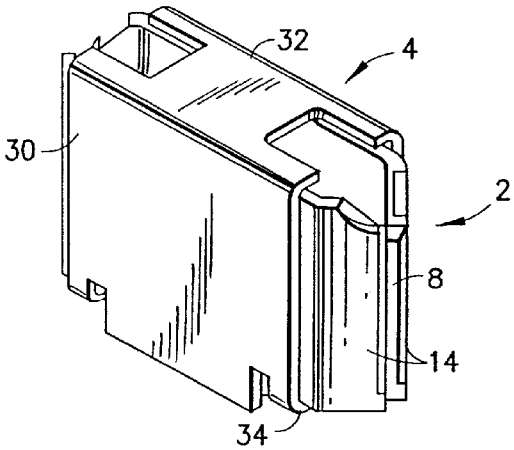
FIG. 4 is a perspective view in the fitted position of a second embodiment.
Figure 5:
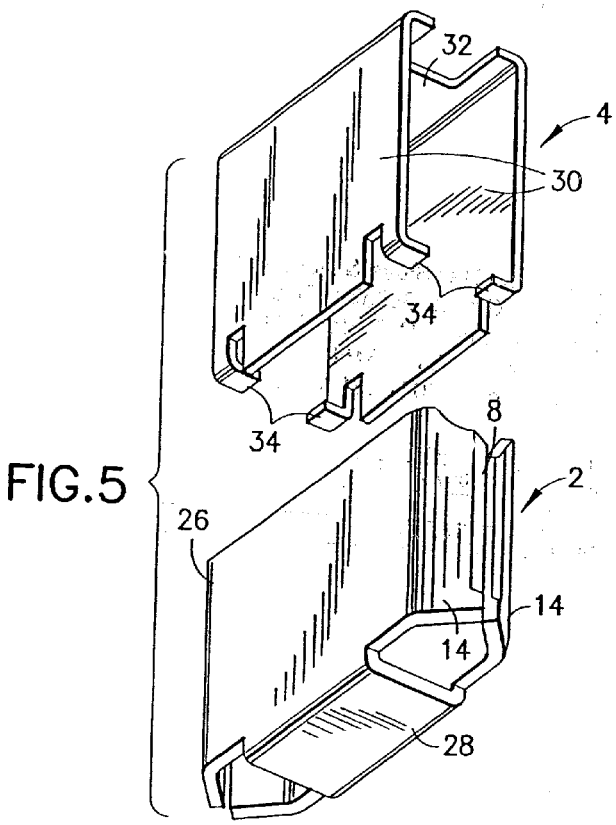
Figure 6:
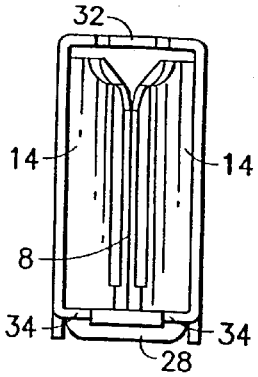
Figure 7:
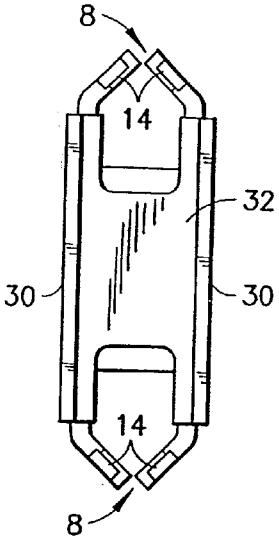
Figure 8:
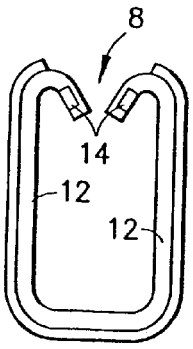
Figure 9:
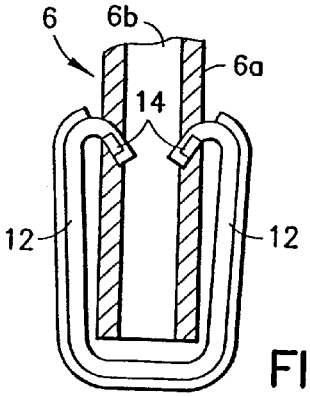
Figure 10:
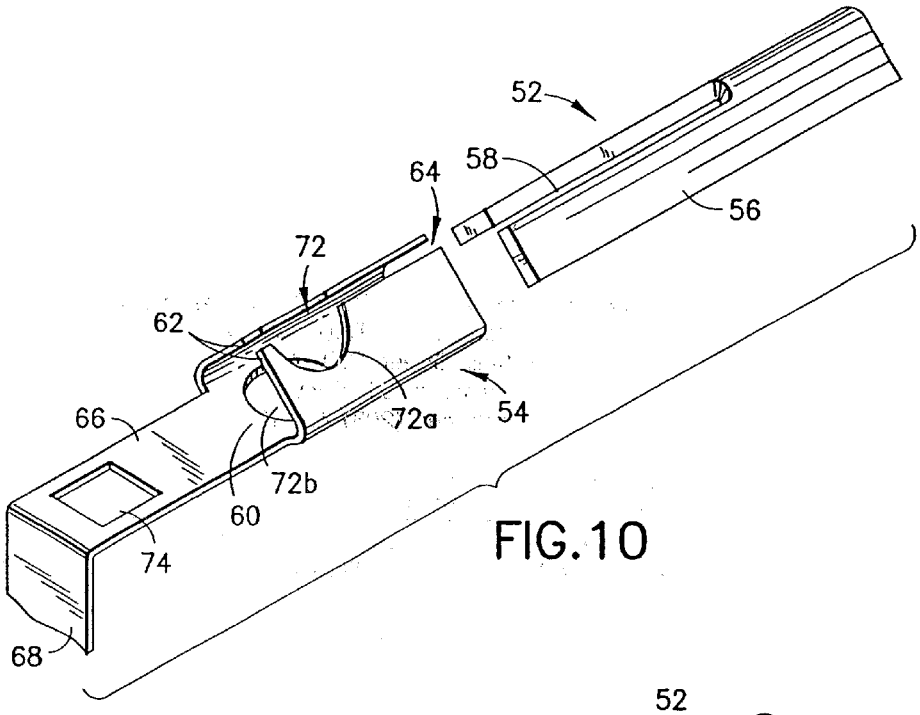
Figure 11:
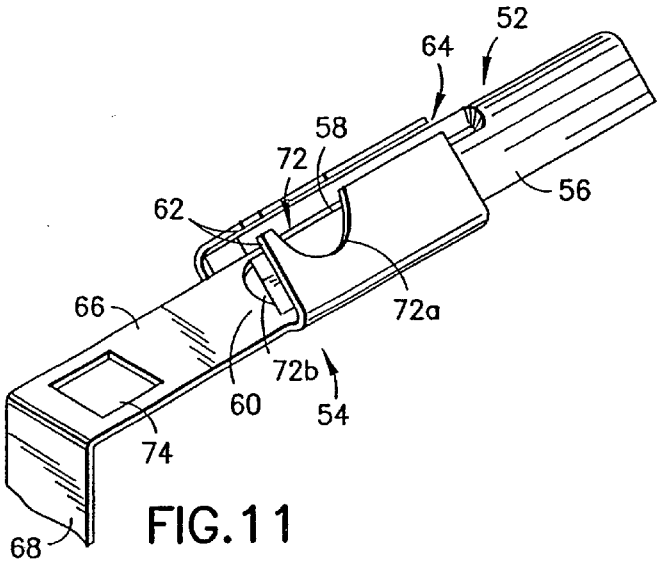

FIG. 1 shows two metal profiled pieces, namely a conducting connection piece 2 and a reinforcement 4. These two pieces 2 and 4, when they are in the fitted position shown in FIGS. 2 and 3, are designed to be incorporated into an item of electrical equipment in order to connect one or more electrical wires 6. These pieces are therefore conventionally immobilized in housings provided for this purpose in a casing of the electrical equipment, which casing consists, for example, of an assembly of two complementary half-shells fastened together by welding, for example ultrasonic welding, after various devices, such as conducting connection pieces, have been introduced.

The shape of the connection piece 2 adopts the characteristics, with regard to its shape, of the connection pieces already known from the patents of the prior art such as, for example, the document EP-0 247 360.

This piece 2 has a stripping and retaining slit 8 which in this case is straight and parallel to the longitudinal axis of the profiled connection piece 2. It is obtained, for example, from a flat blank by stamping, involving cutting, followed by folding and optionally with the formation of thinned areas.

The connection piece 2 here has a hollow polygonal cross section which corresponds to a U having a base 10 and two branches 12, the free ends of which have been obliquely and evenly bent over toward each other. The free end of each bent-over part 14 forms one edge of the stripping and retaining slit 8. These parts 14 may possibly be gradually thinned toward the slit 8.

At each of its ends, the stripping and retaining slit 8 has a stripping mouth 16, thus forming a double-entry connection piece 2. This mouth 16 is obtained by making a symmetrical oblique cut in the bent-over parts 14 at their ends. This oblique cut makes it possible to obtain a flared mouth, the edges 18 of which form a sharp edge able to cut into a sheath 6*a* of a wire pushed into the mouth 16.

The connection piece 2 is, for example, made of copper or else a copper alloy having a high proportion of copper. Thus, when a wire 6 has been inserted into the slit 8 and its sheath 6*a* has been cut into at the mouth 16, the conducting core 6*b* of this wire is in electrical contact with the edges of the slit 8. The material of which the connection piece is made then allows excellent conduction of the current flowing in the wire 6.

The connector according to the invention also comprises a reinforcement 4. In the embodiment of FIGS. 1 to 3, this reinforcement has a profiled shape similar to that of the connection piece 2. It has in fact a cross section in the general form of a U with free ends bent over toward the inside of the U. Thus, there is a base 20, two branches 22 and, at the free end of each of the latter, a bent-over part 24.

The shape of the internal surface of the profiled part forming the reinforcement 4 is such that it follows the external shape of the connection piece 2. However, the bent-over parts 24 of the reinforcement are less extended than the bent-over parts 14 of the connection piece 2. They allow good mechanical fastening of the reinforcement 4 to the connection piece 2 without, however, running the risk of impeding the sliding movement of the wire 6 in the slit 8, especially so as to prevent coming into contact with the sheath 6*a*.

The connection piece 2 and the reinforcement 4 in the fitted position (FIGS. 2 and 3) are joined together quite tightly in order to prevent any longitudinal sliding between these two pieces. The reinforcement 4 grips the connection piece 2 in the manner of a staple.

The reinforcement 4 is made of steel. It therefore has advantageous elastic properties that copper—a very good electrical conductor—does not have. Thus, when a wire is inserted into the slit 8, the branches 12 of the connection piece 2 and the branches 22 of the reinforcement 4 are moved apart. The resilient reinforcement 4 then exerts, on the connection piece 2, the elastic return force that returns it to the initial rest position, which makes it possible to guarantee good electrical contact between the core 6*b* of the wire 6 and the edges of the slit 8. This good contact is guaranteed for wires 6 having diameters that differ over quite a wide range of wire diameters.

FIGS. 4 to 7 illustrate an alternative embodiment of a connector according to the invention. The same reference numbers as those used in FIGS. 1 to 3 will be used again here to denote similar elements.

Here again, there is a reinforcement 4 and a connection piece 2. The reinforcement is preferably made of steel and the connection piece of a material which is a very good conductor, such as copper or a copper-based alloy.

The connection piece 2 has two side walls 26 joined by a linking piece 28 which joins one edge of a wall 26 to an edge of the other wall 26. The adjacent edges of the joined edges are bent over toward the other side wall 26, thus forming a bent-over part 14 defining the edge of a stripping and retaining slit 8. This slit has, at its end on the opposite side from the linking piece 28, a stripping mouth 16. The shape of each slit 8 and of each mouth 16 is, for example, similar to that already described above with reference to FIGS. 1 to 3.

The connection piece 2 may thus be regarded as a profiled piece having an axis parallel to the slits 8.

As regards the reinforcement 4, this also has two side walls 30 and a linking piece 32 which connects one edge of a wall 30 to an edge of the other wall 30. This reinforcement may be regarded as a profiled piece having an approximately U-shaped cross section. The axis of this reinforcement 4 (FIG. 4) is perpendicular to the slits 8 and parallel to the side walls 26 and 30.

The reinforcement 4 is fitted over the connection piece 2 in such a way that the side walls 30 of the reinforcement rest against the external face of the side walls 26 of the connection piece 2, the linking piece 32 of the reinforcement lying on the opposite side from the linking piece 28 of the connection piece 2. The reinforcement 4 here also grips the connection piece 2 in the manner of a staple. The pieces 2 and 4 may be dimensioned so that the grip between them is sufficient to avoid any risk of them sliding with respect to each other. However, it is preferable to provide, as illustrated in the drawing, tabs 34 made at the edges of the free ends of the reinforce 4 so as to provide positive retention between the two pieces.

Thus, for both stripping slits 8, excellent electrical contact is made between a wire 6 introduced into a slit 8 and the connection piece 2 for diameters of wires 6 varying within a predetermined range. For each of the slits, the reinforcement 4 exerts a force, making the edges of the slit 8 bear against the core 6*b* of the wire, which is sufficient to guarantee the quality and reliability of the electrical contact.

Figure 5:
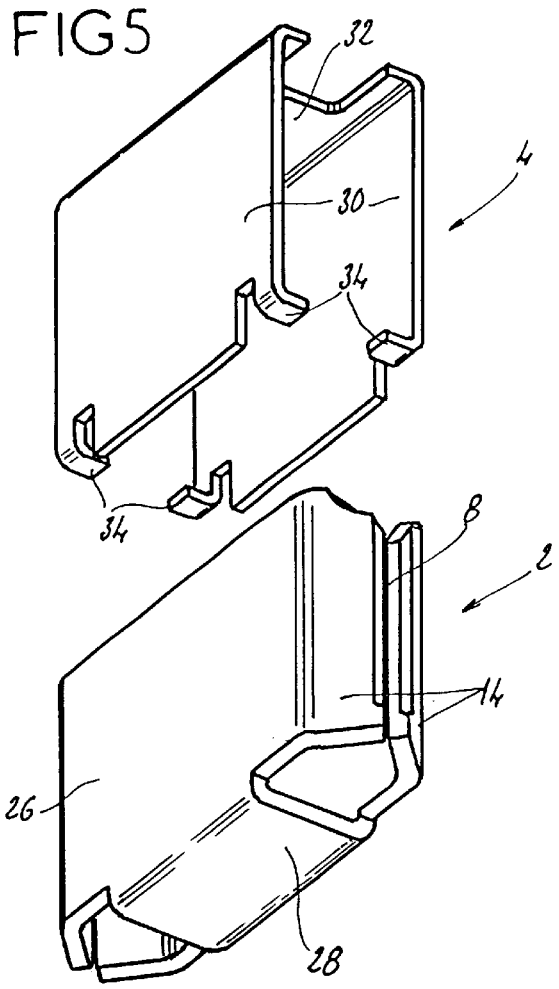
FIG. 5 is an exploded perspective view of the connector of FIG. 4.
Figure 6:
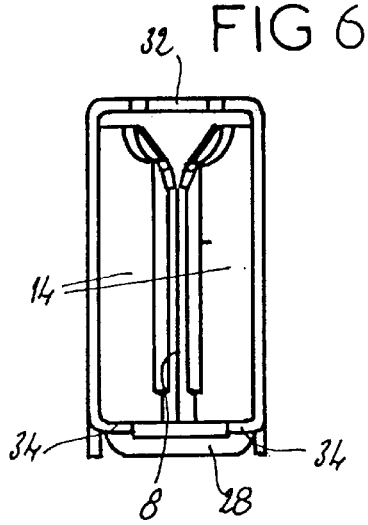
FIG. 6 is a front view of the connector of FIGS. 4 and 5.
Figure 7:
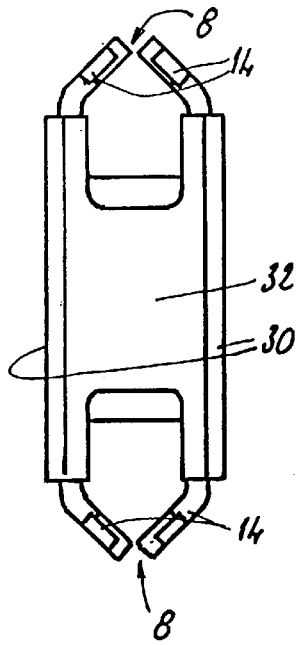
FIG. 7 is a top view of the second embodiment.
Figure 8:
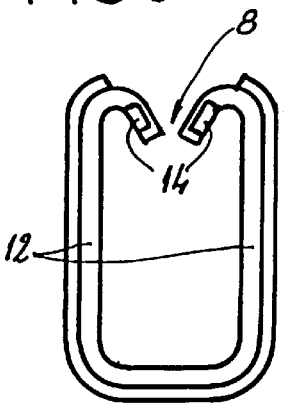
FIG. 8 is a front view of a third embodiment.
Figure 9:
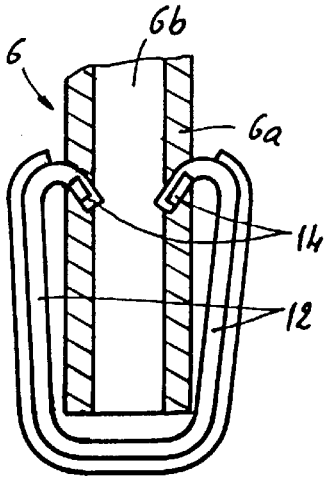
FIG. 9 shows the connector of the previous figure in which a cable is connected.

FIGS. 8 and 9 show an alternative embodiment of the connector of FIGS. 1 to 3, seen from the front.

The difference between this embodiment and the first embodiment shown in FIG. 3 lies in the bent-over parts 14. In FIG. 3, the ends of the branches 12 are bent over through an angle of less than 90° (approximately 45° in the figure) so that the bent-over parts 14 are oriented away from the base 10. In FIGS. 8 and 9, the ends of the branches 12 of the connection piece are bent over through an angle of greater than 90° (approximately 135° in FIGS. 8 and 9) so that the bent-over parts 14 are in a reentrant position, i.e. they are oriented toward the base 10.

The reinforcement 4 illustrated in FIGS. 8 and 9 is unchanged with respect to the reinforcement 4 of FIGS. 1 to 3.

The embodiment of these two figures has the advantage of allowing better retention of the wire inserted between the edges of the slit 8 of the connection piece.

FIGS. 10 to 15 show a fourth embodiment of the connector according to the invention. Here, the reinforcement is no longer fixed with respect to the connection piece, as was the case in the embodiments illustrated in FIGS. 1 to 9, rather the reinforcement can move with respect to this connection piece. It also serves as a pusher for introducing a wire 50.

Figure 10:
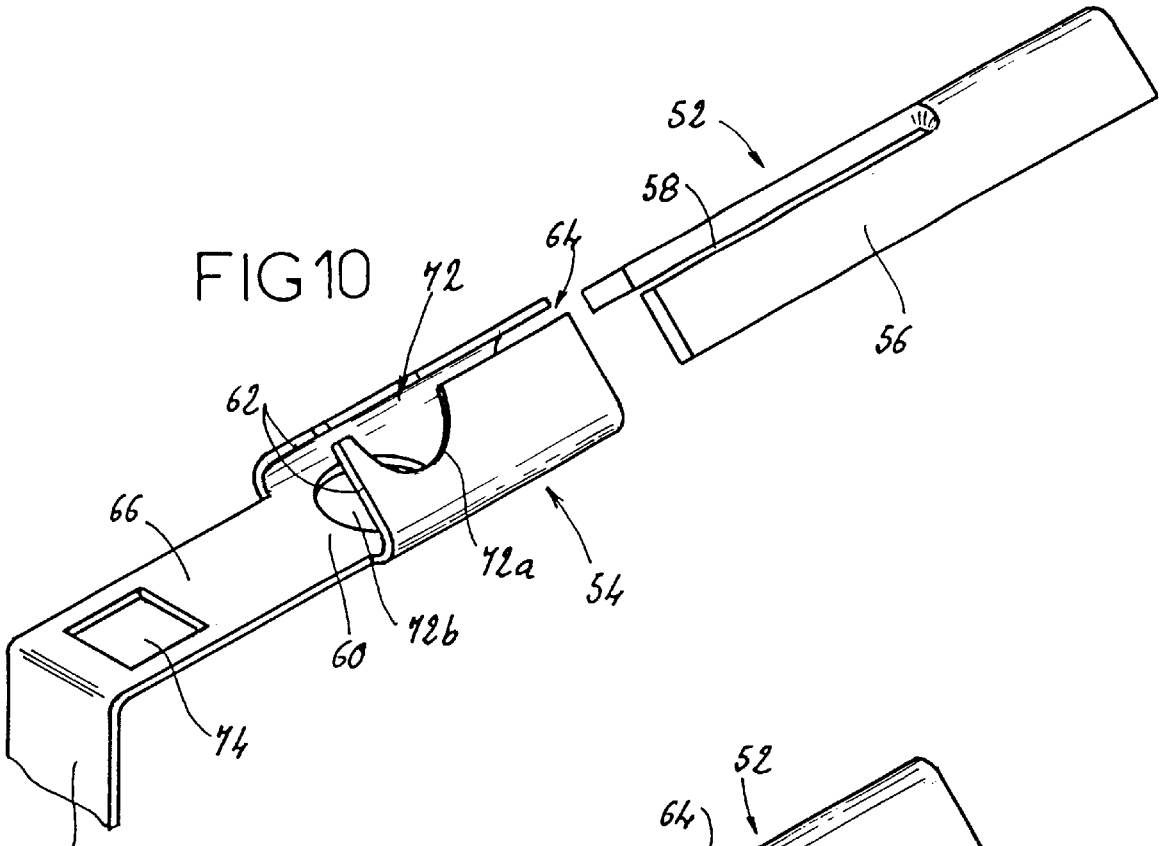
FIG. 10 is an exploded perspective view of a fourth embodiment of a connector according to the invention.

FIG. 10 shows a connection piece 52 and a movable reinforcement 54 in exploded perspective. The position shown in this figure is a position before the connector is fitted into a casing made of an electrically insulating synthetic material.

The connection piece 52 is a profiled piece having a V-shaped cross section. The two branches 56 form, for example, an angle of about 90°. A slit 58 is made at the tip of the V at one end of the connection piece 52. At the other end, the two branches 56 are connected together. In the drawing, the edges of the slit are not thinned, but it is possible, of course, to envisage thinning them, as described with reference to FIGS. 1 to 9.

The reinforcement 54 is a profiled piece of triangular cross section. It is dimensioned so that the connection piece 52 can slide inside its section. This reinforcement has a base 60 and two sides 62. The two sides form between them an angle approximately equal to the angle formed by the branches 56 of the connection piece. They are intended to come into contact with these branches 56. The drawing thus illustrates a situation of a reinforcement 54 having a cross section in the form of a right-angled triangle, the base 60 forming the hypotenuse of this triangle. In order to give resilience to the reinforcement, a slit 64 is produced over the entire length of the reinforcement 54 between the two sides 62, that is to say in the right angle in the example given.

The base 60 of the reinforcement is extended on the opposite side from the connection piece 52 by a blade 66 bent over at its end. The bent-over end forms a lever 68 designed to bear against a stop 70 made in a casing which houses the connector.

Two openings are provided in the reinforcement 54. A first opening 72 is designed to take the wire 50 while a second opening 74 is designed to take the end of a rod, for example the end of a screwdriver 76.

The first opening 72 is made in that part of the reinforcement having a triangular cross section. Thus, there are semi-elliptical recesses 72*a* in the sides 62 and a circular hole 72*b* in the base 60.

The second opening 74 has a square shape in the drawing. It is placed near the lever 68 in that part of the blade 66 which is not bent over.

Figure 11:
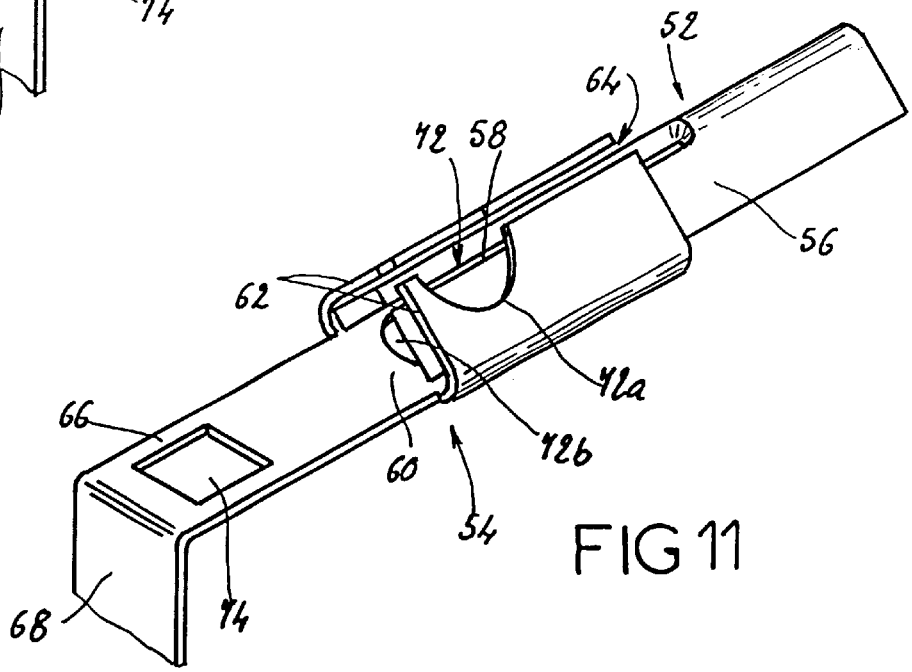
FIG. 11 shows the connector of FIG. 10 in the fitted position.
Figures 12A, 12B, 13A, 13B, 14A, 14B, 15A, 15B:
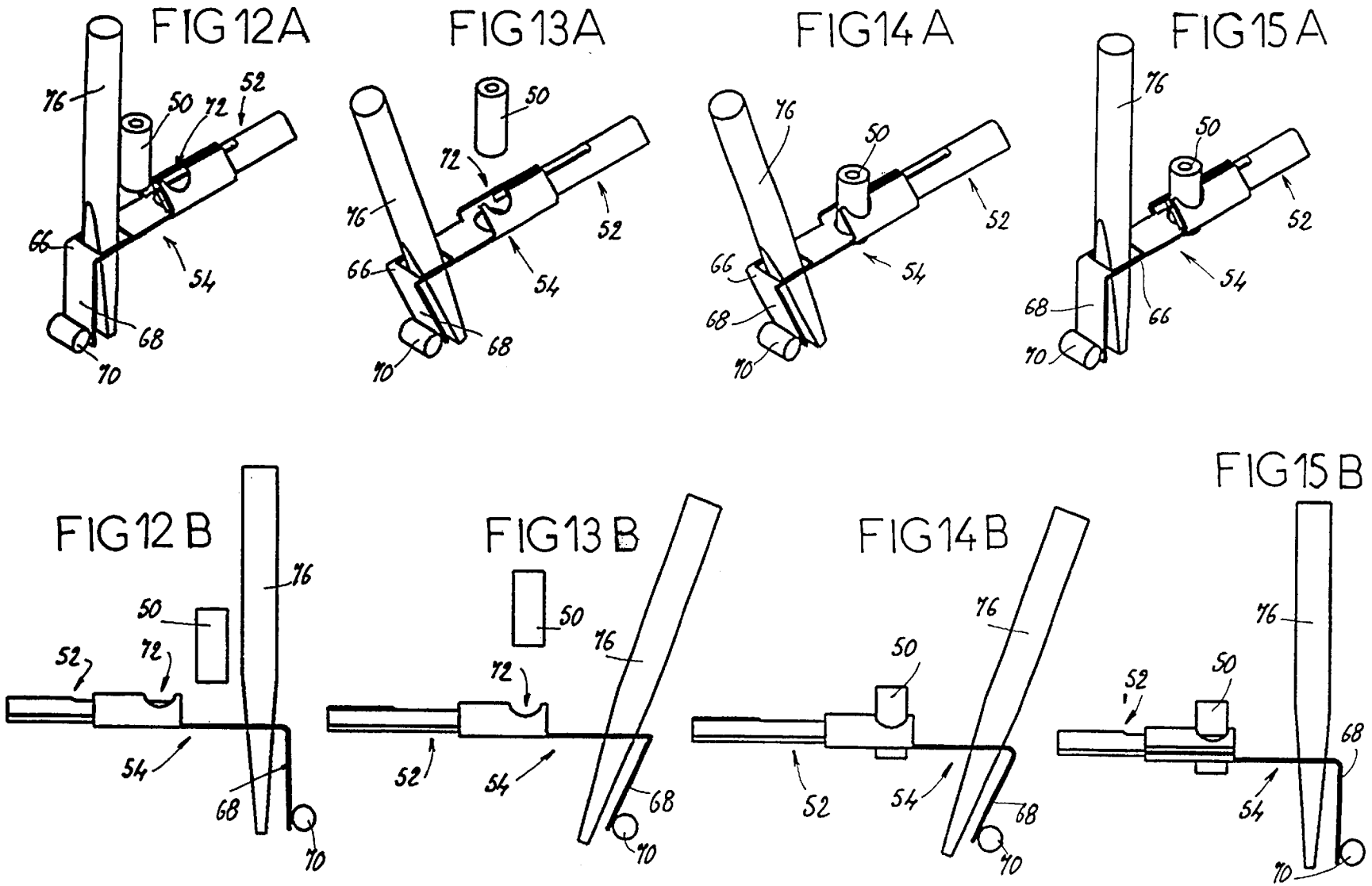

FIG. 11 shows the reinforcement 54 and the connection piece 52 in the interpenetration position corresponding to the connection of a wire 50, not illustrated in this figure.

The materials used for making the connection piece 52 and the reinforcement 54 are, for example, the materials indicated above for making the connection piece 2 and the reinforcement 4.

FIGS. 12 to 15 illustrate the connector of FIGS. 10 and 11 in various positions in order to connect the wire 50. The figures labeled with the letter A show the connector in perspective, while the figures labeled with the letter B show the same connector in side view. In these figures, for the sake of simplification, a casing made of electrically insulating synthetic material has intentionally been omitted, this casing being intended to house the connector illustrated. This casing has at least one opening through which a wire 50 to be connected passes from the outside of the casing toward the connector, as well as an opening through which a tool, the screwdriver 76 for example, passes. These two openings may form only one opening, but it is preferable to have two separate openings.

Figure 12A:
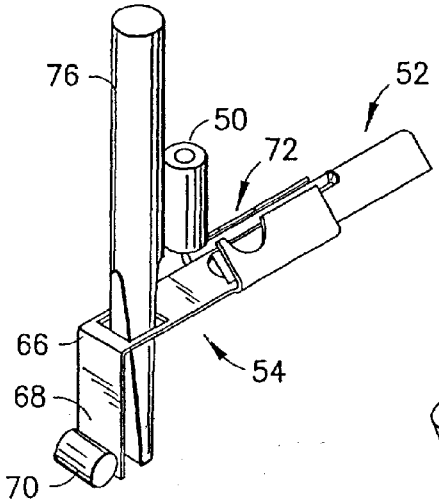
Figure 12B:
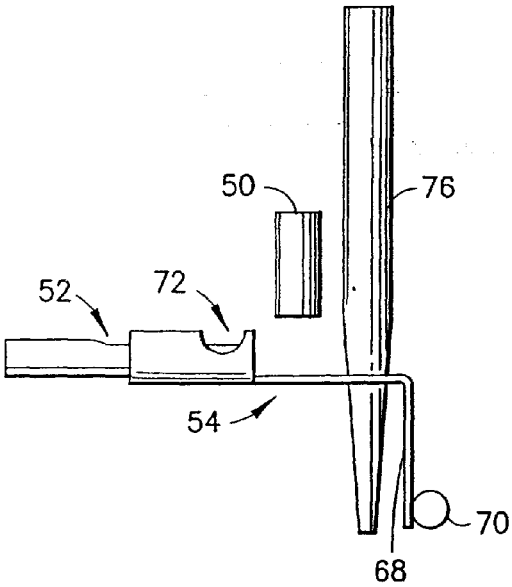

In FIG. 12, the end of a screwdriver 76 is introduced into the opening 74 in the blade 66. The wire 50 is presented parallel to the screwdriver 76.

The end of the screwdriver bears against the stop 70 and the screwdriver is pivoted so as to cause the reinforcement 54 to move away from the connection piece 52. However, care is taken to ensure that the connection piece 52 always remains engaged in the reinforcement 54. For this purpose, a limit may be provided within the opening in the casing through which the screwdriver 76 is intended to pass.

Figure 13A:
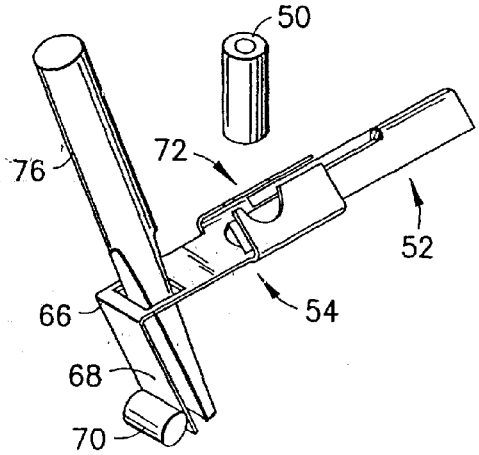
Figure 13B:
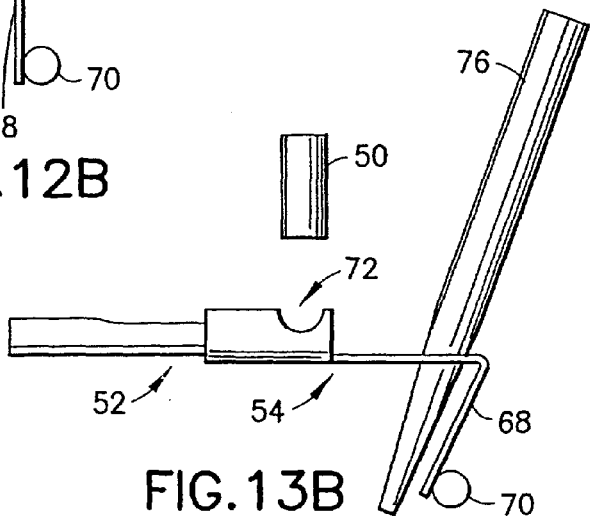

During the pivoting action, the blade 66 is deformed—the angle between the base 60 and the lever 68 varies. Mechanical energy is thus stored. The blade 66 acts as a spring. The preloaded position is shown in FIG. 13.

Figure 14A:
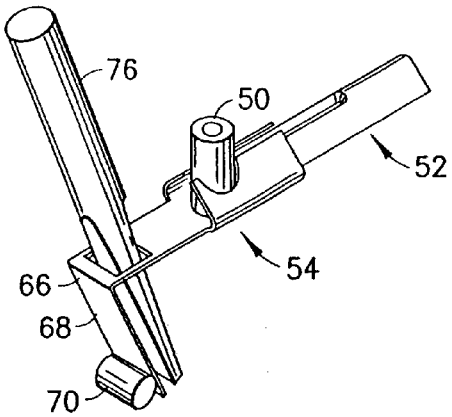
Figure 14B:
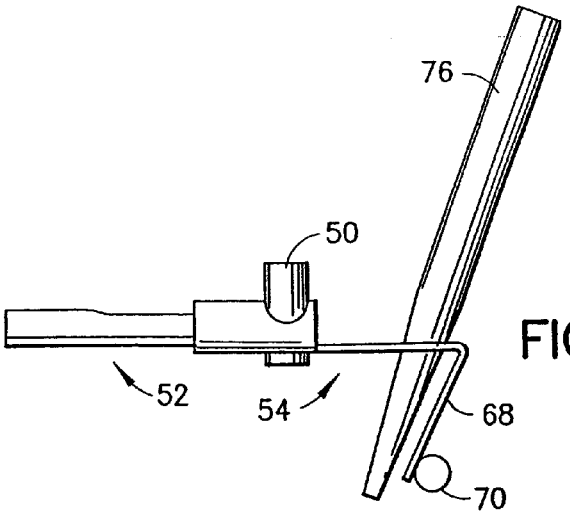

As shown in FIG. 14, the wire 50 is then introduced into the opening 72. It extends beyond the base 60 so as, consequently, to ensure that the wire 50 is properly guided.

Figure 15A:
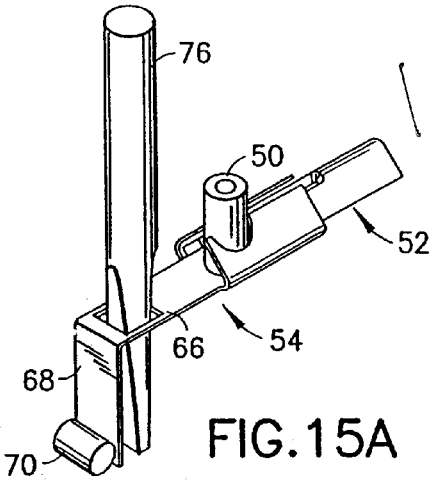
Figure 15B:
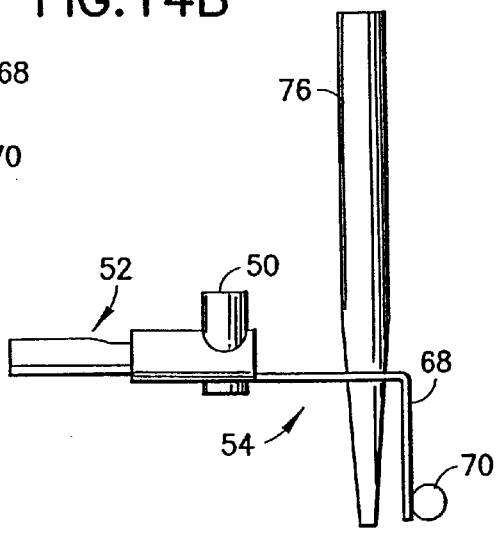

FIG. 15 shows the wire 50 in the connected position. Between the position in FIG. 14 and that in FIG. 15, it is possible to leave the screwdriver blade in the opening 74, as suggested by the drawing. The screwdriver therefore accompanies the reinforcement in its return movement to the unloaded position. However, it is also possible, from the position illustrated in FIG. 14, to remove the screwdriver 76. The energy stored in the blade 66 is then sufficient to bring the reinforcement 54 and the wire 50 into the position illustrated in FIG. 15. The introduction of the wire 50 into the slit 58 causes the wire 50 to be stripped. This stripping is obtained in a conventional manner by cutting into the sheath of the wire 50.

During this operation, the branches 56 of the connection piece are moved apart in order to allow the wire 50 to pass through. This deformation is transmitted to the reinforcement 54, especially at its sides 62, which is elastically deformed. This elastic deformation consequently allows the edges of the slit 58 to exert, continuously over time, a pressure on the core of the wire 50, guaranteeing good electrical contact between the connection piece and the core of the wire.

To disconnect the wire 50 introduced into the slit 58 of the connection piece 52, it suffices to carry out the operation in the opposite direction by passing therefore from the position in FIG. 15 to that in FIG. 14, then to that in FIG. 13 and finally to that in FIG. 12.

All the embodiments described above allow the use of relatively inexpensive materials. They also allow the elasticity and electrical conductivity functions to be optimized more easily than in the case of insulation-displacement connectors of the prior art, by dissociating these two functions.

It goes without saying that the invention is not limited to the embodiments described above by way of nonlimiting examples; on the contrary, it embraces any variant thereof which falls within the scope of the claims given below.

Thus, the shape of the connection pieces and of the reinforcements is given by way of example. The same applies to the materials used. In particular, in the embodiment in FIGS. 10 to 15, it is possible to choose other shapes for the connection piece and the reinforcement. A shape such as that shown for example in FIGS. 1 to 3 could just as well be suitable. All that would be required then would be to provide a different clearance between the connection piece and the reinforcement.

The connection pieces described are not electrically connected. They could, for example, be connected to another identical piece. This electrical connection lies within the competence of those skilled in the art and has not been described above.

What is claimed is:

1. A slit-type insulation-displacement connector for electrical wire, comprising:

a conducting connection piece (2; 52) having a stripping and retaining slit (8; 58) for receiving a wire core, the slit being made longitudinally along the conducting connection piece; and a resilient and elastic metal reinforcement (4; 54) dimensioned so as to continuously engage the conducting connection piece (2; 52) by surrounding the conducting connection piece, thereby causing the conducting connection piece to exert a pressure on the wire core uniformly along the slit, wherein the conducting connection piece is dimensioned to contact the elastic metal reinforcement over substantially the entire length and height of the elastic metal reinforcement, and the conducting connection piece has a shape which is followed by the elastic metal reinforcement (4; 54) which fits tightly over the conducting connection piece, and wherein the stripping and retaining slit (8; 58) is for receiving at least one wire core and has edges that are substantially parallel so that the slit remains substantially straight.

2. The connector as claimed in claim 1, wherein the connection piece (2) has a hollow polygonal cross section adjacent to the stripping and retaining slit (8).

3. The connector as claimed in claim 1, wherein the connection piece (52) has a V-shaped cross section adjacent to the stripping and retaining slit (58), the V-shaped cross section having a tip, and the slit being located at the tip of the V-shaped cross section, the slit being perpendicular to the V-shaped cross section.

4. The connector as claimed in claim 3, wherein the conducting connection piece (2; 52) is made of copper or of a copper-based alloy.

5. The connector as claimed in claim 3, wherein the reinforcement (54) has a profiled part of triangular cross section, in that a side (60) of the triangular part which is opposite the stripping and retaining slit (58) is extended so as to form a resilient blade (66) having a bent part, in that the bent part comes to bear against a stop (70) which is fixed with respect to the connection piece (52), in that a recess (72) is provided in the reinforcement (54) at the profiled part in order to allow the electrical wire (50) intended to be stripped to pass through the stripping and retaining slit (58), and in that an opening (74) is provided in the resilient blade (66) allowing a rod, such as a screwdriver end (76) for example, to pass through the opening.

6. The connector as claimed in claim 4, wherein the metal reinforcement (4; 54) is made of steel.

7. The connector as claimed in claim 6, wherein the metal reinforcement (4) is fitted tightly over the conducting connection piece (2), so as to avoid risk of sliding between the metal reinforcement and the conducting connection piece.

8. The connector as claimed in claim 7, wherein the reinforcement (4) has an axis, the conducting connection piece (2) shares the axis of the reinforcement, and the reinforcement has a cross section substantially identical to the V-shaped cross-section but with slightly larger dimensions.

9. The connector as claimed in claim 7, wherein the conducting connection piece (2) has two opposed stripping and retaining slits (8) as well as a linking element (28) placed on one side, adjacent to the slits (8) in order to join two side walls of the conducting connection piece, and in that the reinforcement (4) is a profiled piece having an axis perpendicular to the stripping and retaining slits (8).

10. The connector as claimed in claim 6, wherein the metal reinforcement (54) is fitted so as to slide with respect to the conducting connection piece (52), longitudinally with respect to the conducting connection piece.

11. The connector as claimed in claim 10, wherein the reinforcement (54) is acted upon by a spring (66, 68), the spring having a surrounding position in which the reinforcement (54) surrounds the connection piece (52) over substantially all of the reinforcement (54), and having a preloaded position in which only one end of the reinforcement (54) surrounds part of the connection piece (52) and in which mechanical energy is stored.

12. The connector as claimed in claim 11, wherein the spring (66, 68) and the reinforcement (54) form only a single piece.

13. The connector as claimed in claim 12, wherein the reinforcement (54) has a profiled part of triangular cross section, in that a side (60) of the triangular part which is opposite the stripping and retaining slit (58) is extended so as to form a resilient blade (66) having a bent part, in that the bent part comes to bear against a stop (70) which is fixed with respect to the connection piece (52), in that a recess (72) is provided in the reinforcement (54) at the profiled part in order to allow the electrical wire (50) intended to be stripped to pass through the stripping and retaining slit (58), and in that an opening (74) is provided in the resilient blade (66) allowing a rod, such as a screwdriver end (76) for example, to pass through the opening.

14. The connector as claimed in claim 1, wherein the conducting connection piece (2; 52) is made of copper or of a copper-based alloy.

15. The connector as claimed in claim 1, wherein the metal reinforcement (4; 54) is made of steel.

16. The connector as claimed in claim 1, wherein the metal reinforcement (4) is fitted tightly over the conducting connection piece (2), so as to avoid risk of sliding between the metal reinforcement and the conducting connection piece.

17. The connector as claimed in claim 16, wherein the reinforcement (4) has an axis, the conducting connection piece (2) shares the axis of the reinforcement, and the reinforcement has a cross section substantially identical to the V-shaped cross-section but with slightly larger dimensions.

18. The connector as claimed in claim 16, wherein the conducting connection piece (2) has two opposed stripping and retaining slits (8) as well as a linking element (28) placed on one side, adjacent to the slits (8) in order to join two sides walls of the conducting connection piece, and in that the reinforcement (4) is a profiled piece having an axis perpendicular to the stripping and retaining slits (8).

19. The connector as claimed in claim 1, wherein the metal reinforcement (54) is fitted so as to slide with respect to the conducting connection piece (52), longitudinally with respect to the conducting connection piece.

20. The connector as claimed in claim 19, wherein the reinforcement (54) is acted upon by a spring (66, 68), the spring having a surrounding position in which the reinforcement (54) surrounds the connection piece (52) over substantially all of the reinforcement (54), and having a preloaded position in which only one end of the reinforcement (54) surrounds part of the connection piece (52) and in which mechanical energy is stored.

21. A slit-type insulation-displacement connector for electrical wire, comprising:

a conducting connection piece (2; 52) having a stripping and retaining slit (8; 58) for receiving a wire core, the slit being made longitudinally along the conducting connection piece; and a resilient and elastic metal reinforcement (4; 54) dimensioned so as to continuously engage the conducting connection piece (2; 52) by surrounding the conducting connection piece, thereby causing the conducting connection piece to exert a pressure on the wire core uniformly along the slit, wherein the conducting connection piece has a shape which is followed by the elastic metal reinforcement (4; 54) which fits tightly over the conducting connection piece, and wherein the stripping and retaining slit (8; 58) is for receiving at least one wire core and has edges that are substantially parallel so that the slit remains substantially straight, wherein the connection piece (52) has a V-shaped cross section adjacent to the stripping and retaining slit (58), the V-shaped cross section having a tip, and the slit being located at the tip of the V-shaped cross section, the slit being perpendicular to the V-shaped cross section, and wherein the conducting connection piece has a certain height up to the V-shaped cross section, the elastic metal reinforcement being substantially dimensioned to at least contact the conducting connection piece throughout the certain height up to the V-shaped cross section.

* * * * *

UNITED STATES PATENT AND TRADEMARK OFFICE

CERTIFICATE OF CORRECTION

PATENT NO. : 6,361,352 B2
DATED : March 26, 2002
INVENTOR(S) : Barrat et al.

It is certified that error appears in the above-identified patent and that said Letters Patent is hereby corrected as shown below:

Title page,
The Title page showing an illustrative figure should be deleted and substitute therefor the attached Title page.

Item [56], References Cited, U.S. PATENT DOCUMENTS, after the "Pasternak" reference, please insert the following reference
-- 4,776,812 10/1988 Boissonnet et al. --.

Item [56], References Cited, FOREIGN PATENT DOCUMENTS, please change the country code of the last reference 0663105 from "FR" to -- EP --.

Drawings,
Delete drawing Figures 1-15B and substitute the attached drawing Figures 1-15B therefor.

Signed and Sealed this

Eighth Day of October, 2002

*Attest:*

*Attesting Officer*

JAMES E. ROGAN
*Director of the United States Patent and Trademark Office*

(12) United States Patent
Barrat et al.

(10) Patent No.: US 6,361,352 B2
(45) **Date of Patent: *Mar. 26, 2002**

(54) INSULATION-DISPLACEMENT CONNECTOR

(75) Inventors: Sylvain Barrat, Belleville sur Saône; Bernard Bechaz, Caluire; Philippe France, Chazelles sur Lyon, all of (FR)

(73) Assignee: Entrelec S.A., Villeurbanne (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/370,391

(22) Filed: Aug. 6, 1999

(30) Foreign Application Priority Data

Aug. 7, 1998 (FR) ..... 98 10311

(51) Int. Cl.[7] ..... H01R 11/20
(52) U.S. Cl. ..... 439/395; 439/406; 439/417
(58) Field of Search ..... 439/395–418, 439/839

(56) References Cited

U.S. PATENT DOCUMENTS 3,027,536 A * 3/1962 Pasternak ..... 174/84 S
4,806,120 A * 2/1989 Baker ..... 439/399
5,810,616 A * 9/1998 Ivey ..... 439/395
6,027,361 A * 2/2000 Burmeister et al. ..... 439/395

FOREIGN PATENT DOCUMENTS

| | | |
|---|---|---|
| DE | 19541137 | 5/1997 |
| EP | 0247360 | 4/1987 |
| EP | 0643440 | 3/1998 |
| FR | 2490029 | 9/1981 |
| FR | 2611406 | 2/1987 |
| FR | 0663105 | 7/1996 |

* cited by examiner

*Primary Examiner*—Neil Abrams
*Assistant Examiner*—Son V. Nguyen
(74) *Attorney, Agent, or Firm*—Ware, Fressola, Van Der Sluys & Adolphson LLP

(57) ABSTRACT

This slit-type insulation-displacement connector for electrical wire comprises a conducting connection piece (2) with a straight stripping and retaining slit (8) for the core of a wire. The slit is made longitudinally along a profiled part of the conducting piece. This connector furthermore comprises a metal reinforcement (4) made in a resilient material, which follows the shape of conducting piece (2) by surrounding it.

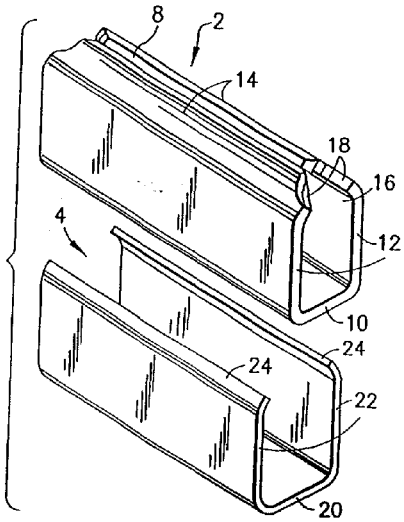

21 Claims, 4 Drawing Sheets